US008695376B2

(12) United States Patent
Mak

(10) Patent No.: US 8,695,376 B2
(45) Date of Patent: Apr. 15, 2014

(54) CONFIGURATIONS AND METHODS FOR OFFSHORE LNG REGASIFICATION AND HEATING VALUE CONDITIONING

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 548 days.

(21) Appl. No.: 12/529,784

(22) PCT Filed: Dec. 20, 2007

(86) PCT No.: PCT/US2007/026281

§ 371 (c)(1), (2), (4) Date: Sep. 15, 2009

(87) PCT Pub. No.: WO2008/127326

PCT Pub. Date: Oct. 23, 2008

(65) Prior Publication Data

US 2010/0126187 A1 May 27, 2010

Related U.S. Application Data

(60) Provisional application No. 60/911,719, filed on Apr. 13, 2007.

(51) Int. Cl.
*F17C 9/02* (2006.01)
*F25J 3/00* (2006.01)

(52) U.S. Cl.
USPC ..... 62/630; 62/50.2; 62/618; 62/620; 62/631

(58) Field of Classification Search
USPC ..... 62/618–621, 630–631, 50.2
See application file for complete search history.

(56) References Cited

U.S. PATENT DOCUMENTS

| | | | | |
|---|---|---|---|---|
| 5,114,451 | A | 5/1992 | Rambo et al. | |
| 6,089,022 | A | 7/2000 | Zednik et al. | |
| 6,564,579 | B1 | 5/2003 | McCartney | |
| 7,600,396 | B2 * | 10/2009 | Mak | 62/620 |
| 8,110,023 | B2 * | 2/2012 | Mak et al. | 95/237 |
| 2003/0005698 | A1 | 1/2003 | Keller | |
| 2006/0236699 | A1 | 10/2006 | Klochko et al. | |
| 2008/0264100 | A1 * | 10/2008 | Mak et al. | 62/618 |

FOREIGN PATENT DOCUMENTS

| | | | |
|---|---|---|---|
| WO | 2004/109180 | A1 | 12/2004 |
| WO | 2004/109206 | A1 | 12/2004 |
| WO | 2006/066015 | A1 | 6/2006 |

* cited by examiner

*Primary Examiner* — Frantz Jules
*Assistant Examiner* — Keith Raymond
(74) *Attorney, Agent, or Firm* — Fish & Tsang, LLP

(57) ABSTRACT

Contemplated plant configurations and methods employ a vaporized and supercritical LNG stream at an intermediate temperature that is expanded, wherein refrigeration content of the expanded LNG is used to chill one or more recompressor feed streams and to condense a demethanizer reflux. One portion of the so warmed and expanded LNG is condensed and fed to the demethanizer as reflux, while the other portion is expanded and fed to the demethanizer as feed stream. Most preferably, the demethanizer overhead is combined with a portion of the vaporized and supercritical LNG stream to form a pipeline product.

18 Claims, 2 Drawing Sheets

Prior Art Figure 1

CONFIGURATIONS AND METHODS FOR OFFSHORE LNG REGASIFICATION AND HEATING VALUE CONDITIONING

This application claims priority to our U.S. provisional patent application with the Ser. No. 60/911,719, which was filed Apr. 13, 2007.

FIELD OF THE INVENTION

The field of the invention is natural gas processing, especially as it relates to offshore LNG (liquefied natural gas) regasification and subsequent processing in an onshore facility.

BACKGROUND OF THE INVENTION

Offshore LNG regasification has become an acceptable alternative in LNG import and advantageously reduces safety and security concerns of LNG by delivering regasified LNG via a subsea pipeline to an existing onshore pipeline network. However, the so delivered regasified LNG may not always have the desired composition and heating value or Wobbe Index as LNG imports often vary significantly depending on the gas fields and the level of NGL (natural gas liquids) recovery at the LNG liquefaction plant.

Commonly, LNG conditioning to control the heating value (or Wobbe Index) is done onshore by dilution of the LNG with nitrogen. The amount of nitrogen dilution generally increases with the richness of the LNG. Unfortunately, the nitrogen dilution requirement also increases the inerts content of the regasified LNG and could reach 9 vol % when LNG with a heating value of 1170 Btu/scf is imported. This amount of nitrogen dilution would far exceed the typical pipeline gas specification of 3 vol % inerts. Therefore, even with nitrogen dilution for heating value control, the imported LNG must be restricted to the sources with heating values of less than 1,100 Btu/scf, which limits the LNG "spot market" strategy.

Prior Art FIG. 1 depicts a typical known offshore LNG regasification terminal and onshore facility that is equipped with gas heating and nitrogen dilution. The offshore facility receives LNG from LNG carrier 51 via LNG unloading arms 1 to the LNG storage tank 53. The offshore storage tank can be of various designs, either fixed or floating designs (e.g., LNG barge, LNG vessels, or gravity based structure). Vapors generated from the LNG ship during unloading and normal boil-off are recovered by compressing to the offshore fuel gas system. The LNG sendout, typically 200 MMscfd to 1,200 MMscfd, is pumped by in-take primary pump 52 to about 100 psig to feed the secondary pump 54. The high pressure pump discharge stream 2, typically 1,200 to 2,000 psig, is heated by the LNG vaporizers 81 to 40° F. forming stream 3 which enters the sub-sea pipeline 56. The regasification duty for 1,200 MMscfd of LNG sendout is about 660 MM Btu/hr for a typical LNG composition. Once the gas reaches onshore, the gas stream 4 is letdown in JT valve 90 to the pipeline network pressure, typically at 800 psig to 1,200 psig. The JT effect of the pressure letdown operation cools the inlet gas from 40° F. to about −20° F. forming stream 5. To meet the pipeline temperature specification, the pressure letdown gas is reheated using an onshore heater 91. The reheating requirement is about 120 MM Btu/hr for 1,200 MMscfd sendout. For heating value or Wobbe Index control of the sales gas, nitrogen dilution using stream 95 is injected to the reheated gas to meet pipeline specifications in sales gas 21.

Therefore, conventional offshore LNG regasification methods require significant heat input. Typically, regasification of 1,200 MMscfd of LNG sendout to 40° F. requires a total heating duty of about 780 MM Btu/hr supplied from seawater, fuel gas firing, or waste heat from power plants. Consequently, the use of energy-efficient, and environmentally friendly air exchangers is generally not practical for offshore installation due to the large real estate requirement. Unfortunately, most, if not all other types of known vaporizers have negative environmental impacts. For example, seawater vaporizers tend to destroy ocean life within its proximity, and the use of fuel firing creates gaseous emissions and liquid effluents. Further known methods of offshore LNG regasification facilities have been proposed as shown, for example, in U.S. Pat. No. 6,089,022 where LNG is regasified onboard an LNG tanker using seawater as the heat source before transferring the gas to an onshore facility.

Other known methods and configurations for Btu control of import LNG remove C2+ hydrocarbons from LNG in a process that includes vaporizing the LNG in a demethanizer using a reboiler, and re-condensing the demethanizer overhead to a liquid that is then pumped and vaporized (see e.g., U.S. Pat. No. 6,564,579). Offshore installation of such processes is very costly and problematic, particularly the hazard and safety risks associated with storing the so produced propane and heavier liquids.

Thus, while numerous configurations and methods of offshore LNG regasification are known in the art, numerous problems remain. For example, all known offshore regasification configurations generate emissions and/or have substantial environmental impact. Moreover, offshore Btu and heating value control is often impractical due to cost and safety concerns. Therefore, there is still a need to provide improved and environmentally acceptable methods and configurations for offshore LNG regasification that is efficiently coupled with onshore LNG processing for Btu and heating value control.

SUMMARY OF THE INVENTION

The present invention is directed to various plant configurations and methods of LNG regasification and processing in which LNG is vaporized to an intermediate temperature at supercritical pressure. Expansion of the so regasified LNG is then employed to provide in separate refrigeration streams for recompressor feed cooling and reflux condensation, and the streams are preferably combined to form a demethanizer feed and reflux that are further reduced in pressure and cooled. Among other advantages, contemplated systems allow formation of a demethanizer reflux stream that has a sufficiently cold temperature to allow recovery of C2 and heavier components.

In one aspect of the inventive subject matter, a method of providing a natural gas product, comprises a step of providing vaporized supercritical LNG at a temperature of −20° F. to 20° F. to an LNG processing unit. In another step, the vaporized LNG is expanded in the LNG processing unit and the refrigeration content of the expanded vaporized LNG is used to provide cooling to a first (and optionally second) recompressor feed and a reflux condenser (e.g., deethanizer reflux condenser) to thereby form a heated vaporized LNG stream. The so heated vaporized LNG stream is split into a first and second portion, and the first portion is condensed to form a reflux stream for a demethanizer having a temperature sufficient for recovery of at least C2 components, while the second portion is turbo-expanded and fed to the demethanizer that produces a demethanizer overhead product.

Preferably, the regasification unit is operated to regasify the LNG to a temperature that is a function of the LNG composition and/or a desired C2 recovery, and most preferably, the vaporized supercritical LNG is provided from an offshore (e.g., more than 50 km offshore) regasification unit. In most cases, the supercritical LNG has a pressure of at least 1200 psig, and the demethanizer is operated at a pressure that is at least about 10% below a critical pressure of the demethanizer bottom (e.g., between about 550 psig to 700 psig). In still further preferred aspects, the demethanizer is coupled to a deethanizer that receives the demethanizer bottom product and operates below the demethanizer operating pressure. Where desirable, it is further contemplated that a portion of the vaporized supercritical LNG is reduced in pressure and combined with demethanizer overhead product to thereby form the pipeline product.

Therefore, in another aspect of the inventive subject matter, a gas treatment plant will include an LNG vaporizer that is configured to provide vaporized supercritical LNG at a temperature of −20° F. to 20° F. Such plants will also comprise an expander that is coupled to the vaporizer and configured to expand the vaporized LNG to thereby form a chilled expanded LNG stream, and first and second heat exchangers that are configured to provide cooling to a first recompressor feed and a reflux condenser (deethanizer reflux condenser), respectively, wherein the first and second heat exchangers are further configured to use refrigeration content of the chilled expanded LNG stream and to thereby form a heated vaporized LNG stream. A third heat exchanger may be included that is configured to condense a first portion of the heated vaporized LNG stream. The demethanizer in such plants is preferably configured to receive the condensed first portion as a reflux and to provide a demethanizer overhead product, wherein a turbo-expander is configured to expand a second portion of the heated vaporized LNG stream to thereby form the demethanizer feed.

Most preferably, the LNG vaporizer is an offshore vaporizer that typically provides LNG at a pressure of at least 1200 psig. It is still further preferred that plants according to the inventive subject matter include a control unit that is operationally coupled to the LNG vaporizer to thereby control the temperature of the regasified the LNG as a function of the LNG composition and/or desired C2 recovery. Moreover, the demethanizer in contemplated plants is configured to operate at a pressure that is at least about 10% (e.g., between 10 and 20%) below a critical pressure of the demethanizer bottom, and most typically at a pressure of between about 550 psig to 700 psig. A deethanizer is preferably coupled to the demethanizer such that the demethanizer provides a bottom product to the deethanizer, wherein the deethanizer is configured to allow operation of the deethanizer at a pressure that is lower than a demethanizer operating pressure. Where desired, a bypass may be implemented that allows combination of the demethanizer overhead product with a (typically partially depressurized) portion of the vaporized supercritical LNG.

Various objects, features, aspects and advantages of the present invention will become more apparent from the following detailed description of preferred embodiments of the invention.

BRIEF DESCRIPTION OF THE DRAWING

Prior Art

DETAILED DESCRIPTION

Figure 1:
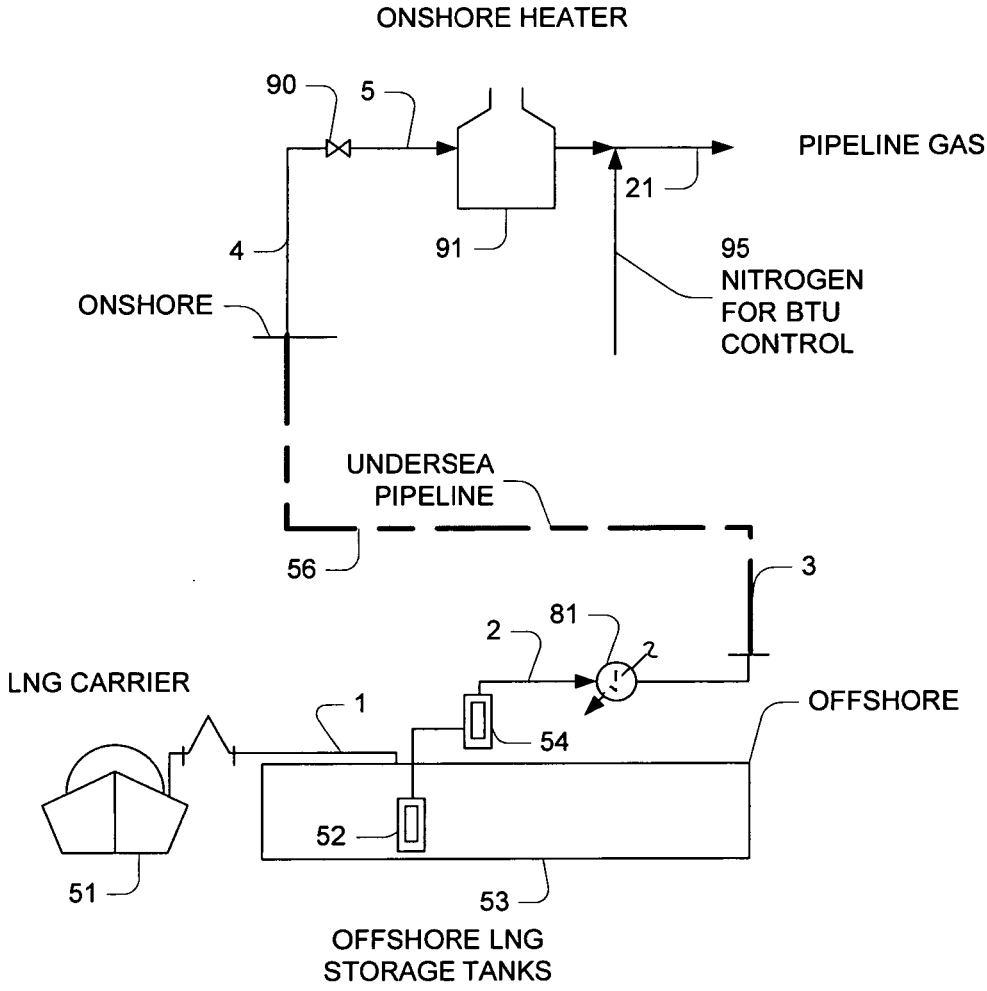
FIG. 1 is a schematic of an exemplary offshore LNG regasification plant.

The inventor has discovered that LNG can be regasified and processed in a simple and effective manner in which LNG is vaporized to an intermediate temperature at a supercritical pressure (e.g., 1200 psig to 1800 psig). Most preferably, the so vaporized LNG is transported from an offshore ambient air vaporizer to an onshore processing unit that recovers the C2+ hydrocarbons for export and/or Btu control in which the relatively low temperature and high pressure provide refrigeration duty for the fractionation of the LNG.

In especially preferred aspects, the supercritical vaporized LNG is expanded and split into various separate streams that provide cooling for selected process steps. After providing refrigeration, the streams are typically rejoined, cooled where needed, and further reduced in pressure to form demethanizer reflux and feed streams. It should be especially appreciated that expansion of at least a portion of the supercritical onshore gas not only provides power to drive the recompressor(s) and deethanizer reflux, but also allows a significant reduction of the recompressor feed temperature. Colder compressor suction significantly increases the recompressor discharge pressure according to the following equation $T_2/T_1=(P_2/P_1)^{[(\gamma-1)/\gamma]}$ wherein $\gamma=C_p/C_v$, wherein $C_p$ is the specific heat at constant pressure and $C_v$ is the specific heat at constant volume, wherein $T_1$ and $P_1$ are the compressor suction temperature and pressure, and wherein $T_2$ and $P_2$ are the compressor discharge temperature and pressure. As the gas suction temperature ($T_1$) is lowered, the discharge pressure ($P_2$) is increased. Viewed from another perspective, at least a portion of the LNG regasification heating is provided by the waste heat from the compressor discharges and reflux condenser, thus eliminating external cooling requirements.

Moreover, it should be noted that vaporizing LNG to an intermediate temperature (e.g., between about −20° F. to about 20° F.) provides various advantages. Most significantly, the lower LNG regasified outlet temperature (e.g., −20° F.) requires substantially less heating duty (about 40%) when compared to conventional LNG regasification process in which the regasified LNG has a temperature of typically 40° F. Consequently, offshore ambient air exchangers can now be implemented due to the lower heating duty and the larger MTD (mean temperature difference) available for an ambient air exchanger that require less heat transfer area and thus allow for smaller air exchangers and footprint. Preferably, the so regasified LNG is then transported to an onshore facility via an undersea pipeline. As discussed further below, it should be noted that the temperature of the regasified LNG will be dependent on LNG composition and/or the desirable C2+ recovery onshore and can be controlled in a relatively simple manner.

In especially preferred configurations, contemplated plants are built as a two column plant in which a first column operates as a refluxed demethanizer, and in which a second column operates as a deethanizer producing an ethane overhead vapor and a bottom C3+ product (i.e., product comprising compounds having three or more carbon atoms). Such configurations will advantageously allow change in component separation and varying levels of C2 production and/or BTU control by changing temperatures and split ratios of the feed stream. Alternatively, or additionally, a bypass conduit may be implemented that allows combination of a portion of the vaporized LNG from the regasification unit with the demethanizer overhead product.

Figure 2:
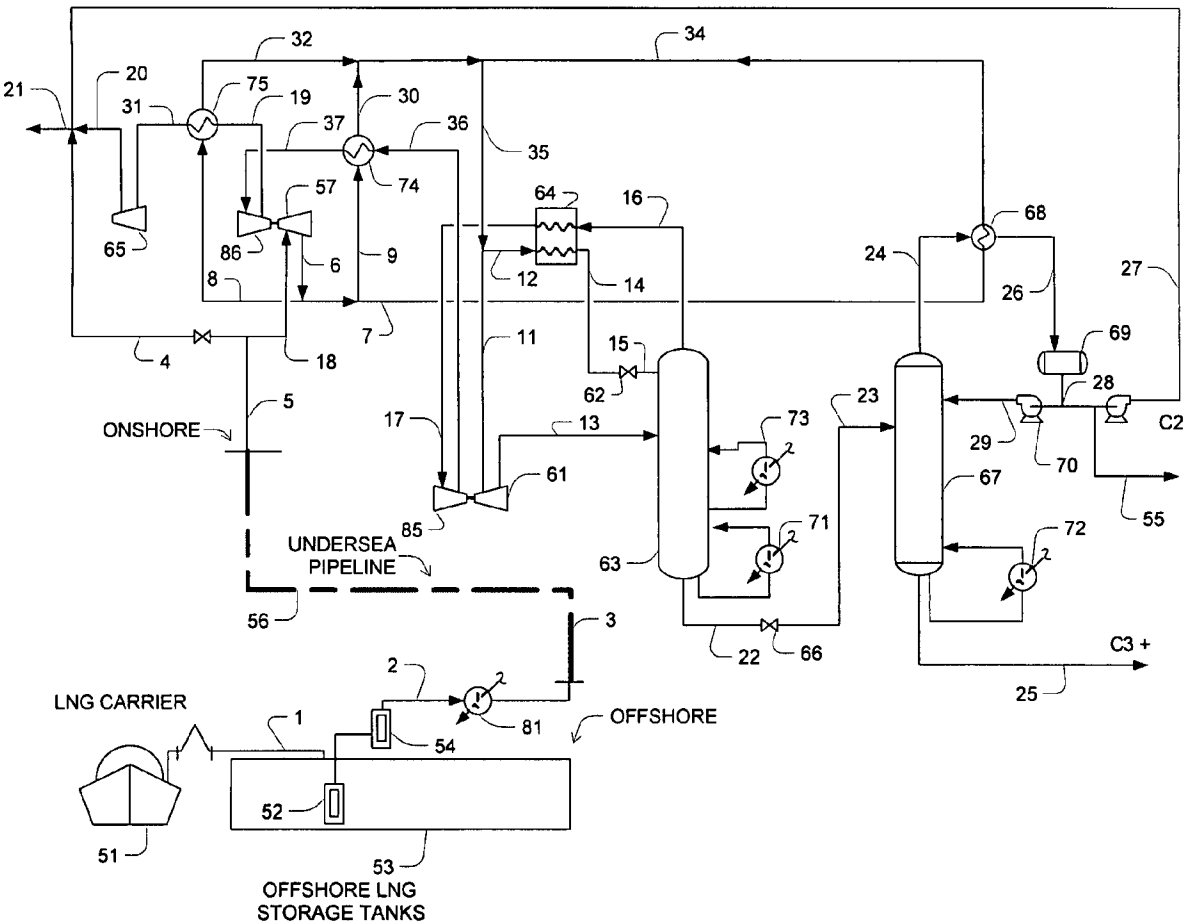
FIG. 2 is a schematic of one exemplary configuration of contemplated offshore LNG regasification plant contemplated herein.

One exemplary scheme of a two column plant configuration is depicted in FIG. 2. Here, the plant comprises an offshore LNG regasification terminal that receives LNG from LNG carrier 51. LNG is unloaded from the carrier via unloading arms to the offshore LNG storage tank 53. The LNG storage tank can be a gravity-based structure, a floating LNG vessel, or other fixed or floating structures. A typical LNG composition (stream 1) and overall material balance for the BTU reduction unit is shown in Table 1.

TABLE 1

| | LNG | ETHANE | LPG | RESIDUE GAS |
|---|---|---|---|---|
| | Stream Number | | | |
| | 1 | 27 | 25 | 21 |
| N2 | 0.0034 | 0.0000 | 0.0000 | 0.0037 |
| C1 | 0.8976 | 0.0216 | 0.0000 | 0.9833 |
| C2 | 0.0501 | 0.9584 | 0.0100 | 0.0116 |
| C3 | 0.0316 | 0.0200 | 0.6277 | 0.0012 |
| iC4 | 0.0069 | 0.0000 | 0.1442 | 0.0001 |
| NC4 | 0.0103 | 0.0000 | 0.2160 | 0.0001 |
| C5 | 0.0001 | 0.0000 | 0.0021 | 0.0000 |
| MMscfd | 1,200 | 49 | 57 | 1,094 |
| BPD | 513,848 | 30,827 | 39,374 | 443,647 |
| HHV, Btu/Scf | 1123 | 1756 | 2765 | 1009 |

LNG from the storage tanks is pumped by the primary pump 52 to an intermediate pressure, typically at about 100 psig. As used herein, the term "about" in conjunction with a numeral refers to a range of that numeral starting from 20% below the absolute of the numeral to 20% above the absolute of the numeral, inclusive. For example, the term "about −100° F." refers to a range of −80° F. to −120° F., and the term "about 1000 psig" refers to a range of 800 psig to 1200 psig. The so pressurized LNG is further pumped by one or more secondary pumps 54 to supercritical pressure, typically about 1200 psig to about 2200 psig to form stream 2. The supercritical LNG is then heated in offshore LNG vaporizers 81 to an intermediate temperature typically at about −20° F. to about 20° F. to form stream 3. It should be noted that the intermediate temperature is predominantly determined by the composition of the LNG and/or the desired C2 recovery level and/or BTU reduction. Most typically, the vaporizer outlet temperature will be lower when higher levels of C2+ extraction and/or Btu reduction are required. While conventional LNG vaporizers can be used for the regasification facility, it is generally preferred that ambient air vaporizers or intermediate fluid vaporizers utilizing waste heat and/or ambient air heating are employed. As shown in FIG. 2, it is generally preferred that the vaporizing facility is located offshore. The so heated LNG is then transported via a (typically thermally insulated) undersea pipeline 56 to the onshore facility.

Once the supercritical vaporized stream 5 reaches onshore, it is split into two portions, stream 4 and stream 18, wherein the ratio between the streams depends on the desirable C2 recovery or BTU reduction levels. For relatively high C2 recovery, the ratio between streams 18 and 4 will be higher while for reduced C2 recovery the ratio between streams 18 and 4 will be lower. Stream 4 typically bypasses the fractionation unit and is mixed without further processing with residue gas stream 20 forming sales gas stream 21 that is fed to the gas pipeline. Where needed, the pressure of stream 4 is reduced to about pipeline pressure, wherein the expansion may be used to provide chilling and/or work. Additionally, excess ethane stream 27 may also be mixed with the gas stream using a mixing device (not shown). It is also noted that by bypassing a portion of the onshore vapor around the first turboexpander, the size of the downstream processing unit can be reduced, lowering the capital cost of the onshore BTU reduction unit. Of course, the actual quantity of bypassed material will predominantly depend on the BTU content of the import LNG, the pipeline gas heating value requirement, and/or the desirable recovery of the C2 and C3+ products.

Stream 18 is letdown in pressure in a first turboexpander 57 forming stream 6, which is typically at a pressure of about 1100 psig and a temperature of about 30° F. to about −60° F. Most preferably, the first turboexpander 57 provides a portion of the compression power to operate the second recompressor 86, which is then operationally coupled to the expander. The refrigeration content of stream 6 is used in various portions of the plant. Most preferably, the refrigeration content of stream 6 is employed (a) to cool the first recompressor discharge stream 36 in exchanger 74 via stream 9, (b) to cool second recompressor discharge stream 19 in exchanger 75 via stream 8, and (c) to provide reflux condensation duty in deethanizer reflux condenser 68 via stream 7. Thus, it should be appreciated that the expanded vapor after providing refrigeration duty is split into two portions with one portion being further expanded in a second expander providing power to drive the recompressor, while the other portion is chilled and condensed by the demethanizer overhead vapor to provide reflux to the demethanizer. Typically, the ratio of the expanded vapor streams is determined based on the feed gas composition, feed gas temperature, and desirable C2 recovery.

The expanded heated streams (stream 32, 30, and 34) are then typically combined to form stream 35 which is further split into two portions, stream 11 and 12. It should be noted that the ratio between streams 11 and 12 is adjusted as necessary to meet the varying levels of BTU reduction or desirable C2+ recovery. When a high C2+ removal is required, the flow of stream 12 relative to stream 11 is increased, resulting in an increase in reflux flow to the overhead exchanger 64 where stream 12 is chilled to a temperature of typically about −90° F. to about −115° F. forming stream 14 which is letdown in pressure in a JT valve 62 to a pressure of about 600 to about 650 psig (at least 10% above the critical pressure of the demethanizer bottom) forming reflux stream 15 to demethanizer 63. Alternatively, the three streams 30, 32, and 34 need not necessarily be combined into a single stream, but may also be combined in two streams (e.g., combination of streams 30 and 32 to form a first stream that may be used as demethanizer feed, and stream 34 not combined to form a second stream that may be used as demethanizer reflux). The power generated by the second turboexpander 61 is preferably used to drive the first recompressor 85. The turboexpander 61 also provides chilling to the feed gas via stream 13, thus supplying a portion of the rectification duty in the demethanizer.

Demethanizer column 63 typically operates at a pressure of between about 600 psig to about 650 psig (or higher) and produces an overhead stream 16 and a bottom stream 22. It should be noted that the temperatures of these two streams will vary depending on the desired levels of C2+ recovery. For example, during high C2 recovery, the overhead temperature is preferably maintained at about −110° F. to about −145° F., as needed for recovery of ethane and heavier components. The demethanizer column bottom temperature is maintained by side reboiler 73 and bottom reboiler 71. During lower C2+ recovery, the overhead temperature may be increased to a temperature of about −60° F. to about −90° F., as needed in rejecting some of the C2 components overhead. The refrigerant content in the demethanizer overhead stream 16 is recovered in heat exchanger 64 by providing cooling to the reflux stream 12. The so heated stream 17 is then compressed by the compressor 85 that is operationally coupled to the second turboexpander forming stream 36, typically at a temperature of about −5° F. to about 10° F., which is further cooled in exchanger 74 using the refrigerant content of the expanded gas stream 9, and which is further compressed by the recompressor 86 driven by the first turboexpander 57 to form stream 19 at a pressure of about 800 psig to about 1200 psig. Where needed, compressor 65 can be added to boost the residue gas pressure to the sales gas pipeline pressure, forming stream 20 that is further mixed with bypass stream 4 and excess ethane stream 27. In still further preferred configurations, one or more additional compressors can be added where high pipeline delivery pressure is required. Prior to boosting pressure, exchanger 75 may be used to refrigerate stream 19 to form stream 31, which is then compressed by compressor 65.

The demethanizer column bottom stream 22 is letdown in pressure by JT valve 66 to a pressure of about 200 to about 450 psig forming stream 23 prior to entering the upper section of the deethanizer column 67. The deethanizer is typically a conventional column that is configured to produce a C2 rich overhead liquid 28 and a C3+ bottom product stream 25. The overhead vapor 24 is condensed in reflux condenser 68 to form stream 26, with cooling supplied by the expanded feed gas stream 7 (which forms heated stream 34). Ethane stream 28 is drawn from the chilled overhead stream 26 in the reflux drum 69. A portion of stream 28 is pumped by reflux pump 70 forming stream 29 as reflux to the deethanizer column, and another portion (stream 55) can be sold as a petrochemical feedstock. The remaining stream is pumped as stream 27 for optional mixing with the product gas. Heating requirement in the deethanizer column is supplied by reboiler 72 using an external heat source.

It is still further preferred that the demethanizer is reboiled with heat from low-level heat sources, using ambient air, waste heat, and/or heat from an intermediate fluid system, and that the deethanizer is refluxed using the refrigerant generated from the expanded inlet gas. Most typically, the demethanizer is operated in contemplated plants at significantly higher pressures than demethanizers in heretofore known plants and methods (typically operated at about 400-450 psig) without sacrificing fractionation efficiency. Therefore, contemplated demethanizer pressures will typically be at about 600 to about 650 psig. It should be noted that higher demethanizer pressure is desirable as the suction pressure to the recompressor is higher, which in turn boosts the recompressor discharge pressure, according to Equation 1 above. However, the operating pressure should stay at least about 10% below the critical pressure of the demethanizer bottom.

It is further preferred that in such methods the expanded feed gas streams are processed in a demethanizer that further produces a demethanizer bottom product, wherein the bottom product is further processed in at least one downstream column operating at lower pressure to produce at least one of an ethane product and a propane-containing product. It should be noted that the C2 liquid from contemplated processes is suitable for sale or export to a petrochemical plant, while excess C2 may be pumped to mix with the lean product gas to thereby form a sales gas with heating value and/or Wobbe Index that meets pipeline specifications.

Accordingly, it is contemplated that an LNG regasification facility include an offshore facility that receives a source of LNG (e.g., LNG carrier, submerged or floating LNG tank or carrier) and a pump fluidly coupled to the source, wherein the pump pumps LNG to supercritical pressure. An offshore regasification unit, preferably ambient air vaporizers, is coupled to the pump and operated to regasify the supercritical LNG to a predetermined temperature (about −20° F. to about 20° F.). Most preferably, a controller is operationally linked with the onshore fractionation facility that sets the temperature of the regasified LNG as a function of gas composition and the desirable C2 recovery. Particularly preferred controllers will control operation of the regasification unit to thereby control the temperature of the vaporized supercritical LNG, wherein particularly preferred controllers will further be configured to use compositional information and/or desired C2 recovery to determine the temperature of the vaporized supercritical LNG.

Further considerations, configurations and methods suitable for use herein are described in our International patent application published as WO 2006/066015, which is incorporated by reference herein Thus, specific embodiments and applications for offshore LNG regasification and BTU control have been disclosed. It should be apparent, however, to those skilled in the art that many more modifications besides those already described are possible without departing from the inventive concepts herein. For example, the offshore portion of contemplated configurations and methods may also be positioned and/or operated in part or in toto onshore. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of providing a natural gas product, comprising:

providing vaporized supercritical LNG at a temperature of −20° F. to 20° F. to an LNG processing unit;

expanding the vaporized LNG in the LNG processing unit, and using refrigeration content of the expanded vaporized LNG to provide cooling to a first and second recompressor discharge stream and a reflux condenser to condense C2 components from a deethanizer overhead product and to thereby completely convert the expanded vaporized LNG into a heated LNG vapor stream;

splitting the heated LNG vapor stream into a first and second vapor portion;

condensing the first vapor portion to form a reflux stream for a demethanizer, wherein the reflux stream has a temperature sufficient for recovery of at least C2 components, and turbo-expanding the second vapor portion and feeding the expanded second vapor portion to the demethanizer; and producing a demethanizer overhead product, and feeding a demethanizer bottom product to the deethanizer.

2. The method of claim 1 wherein the LNG processing unit is operated to regasify the LNG to a temperature that is a function of at least one of an LNG composition and a desired C2 recovery.

3. The method of claim 1 wherein the vaporized supercritical LNG is provided from an offshore regasification unit.

4. The method of claim 1 wherein the supercritical LNG has a pressure of at least 1200 psig.

5. The method of claim 1 wherein the demethanizer is operated at a pressure that is at least about 10% below a critical pressure of the demethanizer bottom.

6. The method of claim 4 wherein the demethanizer is operated at a pressure of between about 550 psig to 700 psig.

7. The method of claim 1 wherein the deethanizer operates at a pressure that is lower than a demethanizer operating pressure.

8. The method of claim 1 further comprising a step of reducing pressure of a portion of the vaporized supercritical LNG and combining the portion at reduced pressure with the demethanizer overhead product to thereby form a pipeline product.

9. A gas treatment plant comprising:

an LNG vaporizer that is configured to provide vaporized supercritical LNG at a temperature of −20° F. to 20° F.;

an expander that is coupled to the vaporizer and configured to expand the vaporized LNG to thereby form a chilled expanded LNG stream;

a first, second, and third heat exchanger configured to provide cooling to a first and second recompressor discharge stream and a reflux condenser of a deethanizer, respectively, wherein the reflux condenser is configured to condense ethane in a deethanizer overhead product, and wherein the first, second, and third heat exchangers are configured to use refrigeration content of the chilled expanded LNG stream and to thereby completely convert the expanded vaporized LNG into a heated LNG vapor stream;

a fourth heat exchanger that is configured to condense a first portion of the heated LNG vapor stream, and a demethanizer that is configured to receive the condensed first portion as a reflux and that is further configured to provide a demethanizer overhead product; and a turbo-expander that is configured to expand a second portion of the heated LNG vapor stream to thereby form a demethanizer feed.

10. The plant of claim 9 wherein the LNG vaporizer is an offshore vaporizer.

11. The plant of claim 10 wherein the LNG vaporizer is configured to provide the vaporized supercritical LNG at a pressure of at least 1200 psig.

12. The plant of claim 9 further comprising a control unit operationally coupled to the LNG vaporizer, wherein the control unit is configured to control a temperature of the regasified LNG as a function of at least one of an LNG composition and a desired C2 recovery.

13. The plant of claim 9 wherein the demethanizer is configured to operate at a pressure that is at least about 10% below a critical pressure of the demethanizer bottom.

14. The plant of claim 9 wherein the demethanizer is configured to allow operation at a pressure of between about 550 psig to 700 psig.

15. The plant of claim 9 further comprising a deethanizer that is fluidly coupled to the demethanizer such that the demethanizer provides a bottom product to the deethanizer.

16. The plant of claim 15 wherein the deethanizer is configured to allow operation of the deethanizer at a pressure that is lower than a demethanizer operating pressure.

17. The plant of claim 9 further comprising a bypass that allows combination of the demethanizer overhead product with a portion of the vaporized supercritical LNG.

18. The plant of claim 9 wherein the reflux condenser is a deethanizer reflux condenser.

* * * * *